US010233815B2

(12) United States Patent
DeVouge et al.

(10) Patent No.: US 10,233,815 B2
(45) Date of Patent: Mar. 19, 2019

(54) MUFFLER JOINT

(71) Applicant: ADMC Holding, LLC, Lebanon, OH (US)

(72) Inventors: Douglas T DeVouge, Brantford (CA); Yinhui (David) Lu, Paris (CA)

(73) Assignee: ADMC Holding, LLC, Lebanon, OH (US)

( * ) Notice: Subject to any disclaimer, the term of this patent is extended or adjusted under 35 U.S.C. 154(b) by 80 days.

(21) Appl. No.: 15/419,158

(22) Filed: Jan. 30, 2017

(65) Prior Publication Data

US 2017/0218831 A1 Aug. 3, 2017

Related U.S. Application Data

(60) Provisional application No. 62/288,075, filed on Jan. 28, 2016.

(51) Int. Cl.
*F01N 13/18* (2010.01)
*F01N 1/08* (2006.01)

(52) U.S. Cl.
CPC ..... *F01N 13/1888* (2013.01); *F01N 1/08* (2013.01); *F01N 13/185* (2013.01); *F01N 13/1844* (2013.01); *F01N 2450/20* (2013.01)

(58) Field of Classification Search
CPC .... F01N 13/1888; F01N 13/1844; F01N 1/08; F01N 13/185; F01N 2450/20
USPC ..... 181/248
See application file for complete search history.

(56) References Cited

U.S. PATENT DOCUMENTS

| | | | | |
|---|---|---|---|---|
| 2,824,619 | A | 2/1958 | Bremer et al. | |
| 5,477,015 | A | 12/1995 | Preslicka et al. | |
| 6,575,267 | B1 | 6/2003 | Stiles et al. | |
| 7,100,736 | B2 | 9/2006 | Flintham | |
| 2006/0065480 | A1* | 3/2006 | Leehaug | F01N 13/14 181/283 |
| 2015/0008068 | A1* | 1/2015 | Hamashima | F01N 13/1888 181/228 |
| 2016/0017788 | A1* | 1/2016 | Drost | F01N 13/1888 181/212 |
| 2018/0156103 | A1* | 6/2018 | Niaz | F01N 13/141 |

FOREIGN PATENT DOCUMENTS

EP 0072886 A1 3/1983

* cited by examiner

*Primary Examiner* — Forrest M Phillips
(74) *Attorney, Agent, or Firm* — Welsh, Flaxman & Gitler LLC

(57) ABSTRACT

A muffler includes an elongated muffler shell body with a first muffler end cap mounted on the first end of the muffler shell body in a manner defining a first muffler joint and a second muffler end cap mounted on the second end of the muffler shell body in a manner defining a second muffler joint. A louver and baffle assembly is mounted within an interior of the muffler shell body. The first end of the muffler shell body includes a first shell bead/ridge and the second end of the muffler shell body includes a second shell bead/ridge, and each of the circumferential edges of the first muffler end cap and the second muffler end cap are formed to define cap bead/ridges shaped and dimensioned for engagement with the first shell bead/ridge of the first end of the muffler shell body and the second shell bead/ridge of the second end of the muffler shell body.

16 Claims, 2 Drawing Sheets

MUFFLER JOINT

CROSS REFERENCE TO RELATED APPLICATION

This application claims the benefit of U.S. Provisional Patent Application Ser. No. 62/288,075, entitled "MUFFLER JOINT," filed Jan. 28, 2016.

BACKGROUND OF THE INVENTION

1. Field of the Invention

The present invention relates to the manufacture of muffler devices for use in automotive exhaust systems.

2. Description of the Related Art

Mufflers are employed in automotive exhaust systems for reducing the sound from an automotive exhaust. Mufflers commonly include an inner space defined by a muffler shell body and muffler end caps. The inner space is divided into chambers by interior baffles that are generally oriented parallel with the muffler end caps. These mufflers also include inlet/outlet pipes joining the chambers and exhausting the gas.

The inlet/outlet pipes are inserted into apertures of the baffles. The inlet/outlet pipes and baffles are fixed together such that the inlet/outlet pipes run generally perpendicularly to the baffles. The baffles and inlet/outlet pipes are inserted into the muffler shell body such that the baffles are generally parallel to each other.

In practice, the muffler shell body is first formed and the muffler end caps are placed at each end of the muffler shell body. In accordance with common practice, the edge of each muffler end cap is folded over along the surface of the muffler shell body to form a mechanical lock joint so as to secure the end caps to the shell body and maintain the interior baffles in place. Each muffler end cap includes an aperture through which respective inlet/outlet pipes extend from the interior of the muffler. The attachment of the muffler end caps commonly employs a standard joint that is either a simple press cap joint or a flanged cap joint, both of which provide a lap seam joint. The standard joint widely in use is a flanged cap that is pressed into a muffler shell and welded on the lap joint all the way around the shell body. The issue commonly encountered with the use of such joints is the fit of the muffler end caps to the muffler shell body. Muffler shell bodies and muffler end caps tend to be inaccurate and these joints create larger than ideal gaps for the welding process. This can either cause failure of the joint, an increase in the weld cycle time, or added filler material being needed to seal the joint.

SUMMARY OF THE INVENTION

It is, therefore, an object of the present invention to provide a muffler including an elongated muffler shell body having a first end with a first opening, a second end with a second opening, an exterior surface forming an exposed surface of the muffler, and an interior surface forming an internal surface of the muffler. The muffler also includes a first muffler end cap mounted on the first end of the muffler shell body in a manner defining a first muffler joint coupling the first muffler end cap to the first end of the muffler shell body. The first muffler end cap includes a circumferential edge with a body of the first muffler end cap extending within a space defined by the circumferential edge of the first muffler end cap. A second muffler end cap is mounted on the second end of the muffler shell body in a manner defining a second muffler joint coupling the second muffle end cap to the second end of the muffler shell body. The second muffler end cap includes a circumferential edge with a body of the second muffler end cap extending within a space defined by the circumferential edge of the second muffler end cap. A louver and baffle assembly is within an interior of the muffler shell body. The first end of the muffler shell body includes a first shell bead/ridge and the second end of the muffler shell body includes a second shell bead/ridge. The circumferential edge of the first muffler end cap includes a first cap bead/ridge shaped and dimensioned for engagement with the first shell bead/ridge to define the first muffler joint and the circumferential edge of the second muffler end cap includes a second cap bead/ridge shaped and dimensioned for engagement with the second shell bead/ridge to define the second muffler joint.

It is also an object of the present invention to provide a muffler wherein each of the first shell bead/ridge and the second shell bead/ridge extends about an entire circumference of the muffler shell body.

It is another object of the present invention to provide a muffler wherein the first shell bead/ridge and the second shell bead/ridge are mirror images of the each other.

It is a further object of the present invention to provide a muffler wherein the muffler shell body has a single wall construction composed of a metal sheet, and the flat sheet includes a first edge and a second edge with first and second lateral edges extending between the first edge and the second edge.

It is also an object of the present invention to provide a muffler wherein each of the first shell bead/ridge and the second shell bead/ridge includes a first shell bead/ridge segment and a second shell bead/ridge segment connected by an arcuate curved shell connecting segment.

It is another object of the present invention to provide a muffler wherein the first shell bead/ridge segment and the second shell bead/ridge segment extend in a direction perpendicular to a longitudinal axis of muffler shell body.

It is a further object of the present invention to provide a muffler wherein each of the first cap bead/ridge and the second cap bead/ridge includes a first cap bead/ridge segment and a second cap bead/ridge segment connected by an arcuate cap connecting segment.

It is also an object of the present invention to provide a muffler wherein the second cap bead/ridge segment is shorter than the first cap bead/ridge segment.

It is another object of the present invention to provide a muffler wherein the first muffler end cap covers the first end of the muffler shell body and the second muffler end cap covers the second end of the muffler shell body.

It is a further object of the present invention to provide a muffler wherein the first muffler end cap includes an aperture and the second muffler end cap includes an aperture It is also an object of the present invention to provide a muffler wherein the muffle is composed of stainless steel.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
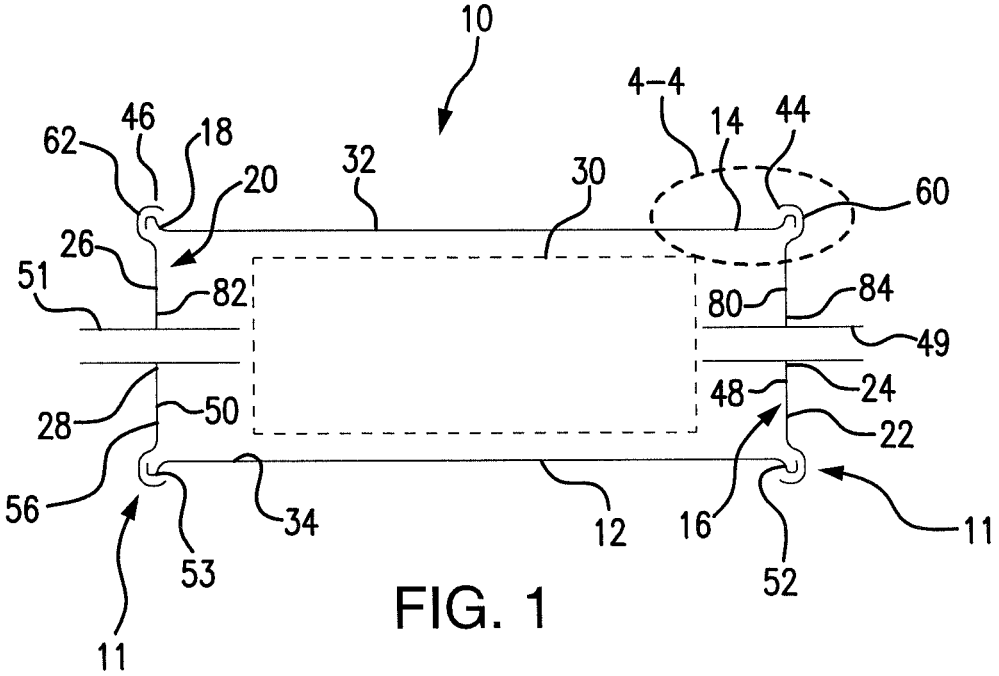
FIG. 1 is a schematic view of a muffler in accordance with the present invention.
Figure 2:
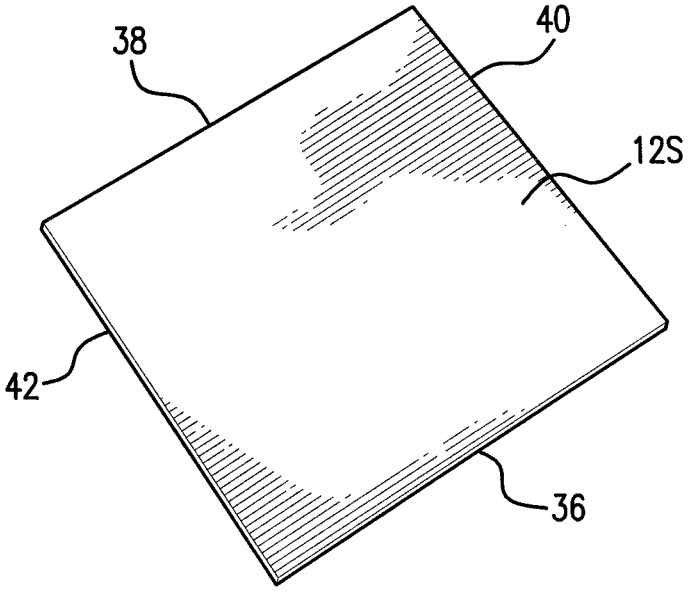
FIG. 2 is a perspective view of a flat sheet used in the fabrication of the muffler shell body.
Figure 4:
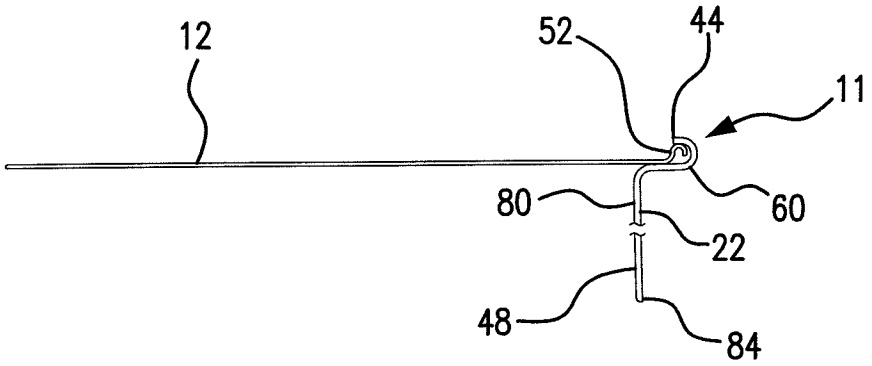
FIG. 4 is a detailed cross-section view of the muffler joint at the Section 4-4 as shown in FIG. 1.
Figure 3:
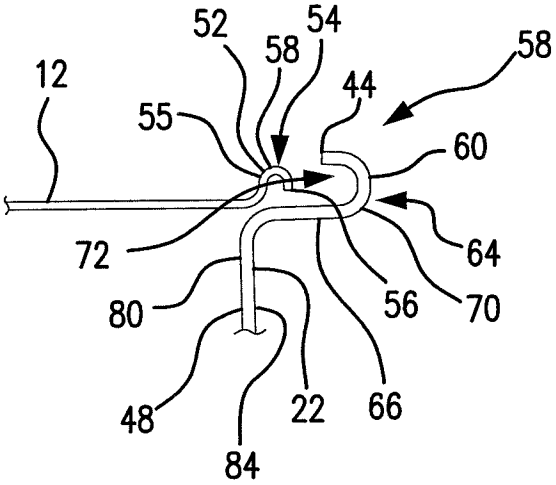
FIG. 3 is a detailed exploded cross-sectional view of the muffler joint prior to assembly of the muffler shell body and the end cap in accordance with the present invention.

With reference to FIGS. 1 to 4, a muffler embodying the present invention is shown and is generally indicated by number 10. The muffler 10 generally includes an elongated muffler shell body 12 having a substantially circular cross-sectional configuration. The muffler shell body 12 has a first end 14 with a first opening 16 and a second end 18 with a second opening 20.

A first muffler end cap 22 is mounted on the first end 14 of the muffler shell body 12 to cover the first opening 16. The first muffler end cap 22 includes an aperture 24 to provide a conduit to the interior of muffler shell body 12. The second end 18 of muffler shell body 12 is closed by a second muffler end cap 26 secured to cover the second opening 20. The second muffler end cap 26 also includes an aperture 28. The interior of the muffler shell body 12 contains a conventional louver and baffle assembly 30, which is conventional and may take various forms without departing from the spirit of the art. Although a variety of known materials may be used in the fabrication of mufflers in accordance with the present invention, a preferred material is 400 Series Ferritic Stainless Steel.

In accordance with a preferred embodiment, muffler shell body 12 is of a single wall construction composed of a single flat sheet 12*s* that is rolled into the configuration of the muffler shell body 12, and thereby defines an exterior surface 32 forming the exposed surface of the muffler 10 and an interior surface 34 forming the internal surface of the muffler 10. Prior to forming the sheet 12*s* into the configuration of the final muffler shell body 12, the sheet 12*s* includes a first edge 36 and a second edge 38 with first and second lateral edges 40, 42 extending between the first edge 36 and the second edge 38. The first edge 36 and the second edge 38 extend in the axial direction of the muffler shell body 12. The first edge 36 and second edge 38 are drawn together in manners known to those skilled in the art. In this way, the sheet 12*s* is formed into the muffler shell body 12 with a generally cylindrical configuration.

Each of the first and second muffler end caps 22, 26 are disk shaped and include an interior surface 80, 82 and an exterior surface 84, 86. As such, each of the first and second muffler end caps 22, 26 includes a circumferential edge 44, 46 with the body 48, 50 of the muffler end caps 22, 26 extending within the space defined by the circumferential edge 44, 46. As briefly mentioned above, each of the muffler end caps 22, 26 also includes an aperture shaped and dimensioned for introducing an inlet/outlet pipe therethrough. As those skilled in the art will appreciate, the first muffler end cap 22 includes an aperture 24 shaped and dimensioned for the passage of the inlet pipe 49 therethrough, wherein the inlet pipe 49 is connected with an upstream side exhaust pipe (not shown), and the second muffler end cap 26 includes an aperture 28 shaped and dimensioned for the passage of the outlet pipe 51 therethrough, wherein the outlet pipe 51 is connected with a downstream side exhaust pipe (not shown). Between the inlet pipe 49 and the outlet pipe 51 are the internal components of the muffler 10 which are not shown in detail and may take a variety of forms known to those skilled in the art.

After the internal components of the muffler 10 are assembled within the muffler shell body 12, the first and second muffler end caps 22, 26 are respectively secured to the first and second ends 14, 18 of the muffler shell body 12 creating a muffler joint 11 in accordance with the present invention. The muffler joint 11 defined by the respective connection of the first and second muffler end caps 22, 26 with the first and second ends 14, 18 of the muffler shell body 12 assists with welding and/or brazing of the muffler end caps 22, 26 to muffler shell body 12. The muffler joint 11 of the present invention is especially applicable for thin walled muffler shell bodies where rigidity is an issue.

In accordance with the muffler joint 11 of the present invention, a circumferential shell bead/ridge 52, 53 is formed at both the first end 22 and the second end 26 of the muffler shell body 12. The first and second shell bead/ridges 52, 53 extend about the entire circumference of the muffler shell body 12. The first and second shell bead/ridges 52, 53 add "hoop" strength to the muffler shell body 12 and makes the end size of the muffler 10 more repeatable. The first and second shell bead/ridges 52, 53 may also be used as variables in the manufacturing process to adjust for variations in the thickness of the muffler shell body 12 or the muffler end cap 22, 26 size via adjustments to the height of the first and second shell bead/ridges 52, 53 during their forming process.

It is appreciated the first and second shell bead/ridges 52, 53 respectively at the first and second ends 14, 18 of the muffler shell body 12 are mirror images of the each other. Therefore, only the first shell bead/ridge 52 at the first end 14 of the muffler shell body 12 is described below as it is understood the second shell bead/ridge 53 at the second end 18 of the muffler shell body 12 is identical. In particular, the first shell bead/ridge 52 is a radially outwardly extending protrusion 54 formed at the first lateral edge 40 of the sheet 12*s* making up the muffler shell body 12. With this in mind, and considering the muffler shell body 12 as it extends from the central portion of the muffler shell body 12 toward the first lateral edge 40, the first shell bead/ridge 52 is composed of a first shell bead/ridge segment 55 and a second shell bead/ridge segment 56 connected by an arcuate curved shell connecting segment 58, wherein the first shell bead/ridge segment 55 and the second shell bead/ridge segment 56 extend in a direction perpendicular to the longitudinal axis of muffler shell body 12. The first shell bead/ridge 52 is formed by bending the muffler shell body 12 to form a concave bend (when viewed from the exterior of the muffler shell body 12) leading to the first shell bead/ridge segment 55, which is directed perpendicular to the longitudinal axis of muffler shell body 12. The muffler shell body 12 is then bent to form a convex bend (when viewed from the exterior of the muffler shell body 12) leading to the second shell bead/ridge segment 56, which is directed perpendicular to the longitudinal axis of muffler shell body 12, wherein the convex bend defines the connecting member 58. The second shell bead/ridge segment 56 ends at the first lateral edge 40 of the sheet 12*s* making up the muffler shell body 12.

The circumferential edges 44, 46 of the first and second muffler end caps 22, 26 are formed to define circular first and second cap bead/ridges 60, 62 shaped and dimensioned for respective engagement with the first and second shell bead/ridges 52, 53 formed at the first and second ends 14, 18 of the muffler shell body 12. As will be explained below, the first and second muffler end caps 22, 26 are provided with mating first and second cap bead/ridges 60, 62 providing for a radial "ball joint" fit when the first and second shell bead/ridges 52, 53 of the muffler shell body 12 are respectively secured therein. The interaction between the first and second shell bead/ridges 52, 53 of the muffler shell body 12 and the first and second muffler end caps 22, 26 also allows for a controlled area/joint for filler metal to form into and thus maximize the contact area for the welding filler material.

It is appreciated the first and second cap bead/ridges 60, 62 of the first and second muffler end caps 22, 26 are mirror images of the each other. Therefore, only the first cap bead/ridge 60 of the first muffler end cap 22 is described below as it is understood the second cap bead/ridge 62 of the second muffler end cap 26 is identical. In particular, the first cap bead/ridge 60 is a laterally outwardly extending protrusion 64 formed adjacent the first circumferential edge 44 of the first muffler end cap 22. With this in mind, and considering the first muffler end cap 22 as it extends from the center of the first muffler end cap 22 toward the circumferential edge 44, the first cap bead/ridge 60 is composed of a first cap bead/ridge segment 66 and a second cap bead/ridge segment 68, which is shorter than the first cap bead/ridge segment 66, connected by an arcuate cap connecting segment 70, wherein the first cap bead/ridge segment 66 and a second cap bead/ridge segment 68 extend in a direction parallel to the longitudinal axis of the muffler shell body 12 and perpendicular to the plane in which the muffler end cap 22 lies. The first cap bead/ridge 60 is formed by bending the first muffler end cap 22 to form a concave bend (when viewed from the exterior side of the first muffler end cap 22) leading to the first cap bead/ridge segment 66, which is directed perpendicular to the plane in which the first muffler end cap 22 lies and parallel to the longitudinal axis of muffler shell body 12. The muffler shell body 12 is then bent to form a convex bend (when viewed from the exterior side of the first muffler end cap 22) leading to the second cap bead/ridge segment 68, which is directed perpendicular to the plane in which the first muffler end cap 22 lies and parallel to the longitudinal axis of muffler shell body 12, wherein the convex bend defines the connecting member 70. The second cap bead/ridge segment 68 ends at the end of the muffler end cap 22. The first and second cap bead/ridge segments 66, 68 define a recess 72 along the interior surface 80 of the first muffler end cap 22 into which the first shell bead/ridge 52 segment may be positioned.

The assembly process involves pressing the muffler end caps 22, 26 to the muffler shell body 12 and holding the muffler shell body 12 under mechanical pressure during the welding process. In accordance with a preferred embodiment GMAW (Gas Metal Arc Welding) is employed, but it is contemplated the final product will be produced with "Laser Brazing". This requires a specialty grade of Ferritic Stainless Steel and brazing wire and the muffler joint 11 of the present invention is uniquely suited for this process. In addition, the filler material used for the GMAW welding will preferably be a 409Ti wire product, which is currently available on the market. However, and where laser brazing is employed in accordance with the present invention it is contemplated a specialty wire in a spool format will be required. In particular, and with reference to the first end 14 of the muffler shell body 12, the first shell bead/ridge 52 at the first end 14 of the muffler shell body 12 is positioned within the first cap bead/ridge 60 of the first muffler end cap 22 such that the first shell bead/ridge 52 at the first end 14 of the muffler shell body 12 is pressed into the recess 72 defined by the first cap bead/ridge 60 of the first muffler end cap 22. This process is repeated to secure the second muffler end cap 26. Maintaining end pressure on the muffler shell body/end caps will insure a good fit 360 degrees around the shell end against the first and second muffler end caps 22, 26. The muffler joints 11 defined by the first and second shell bead/ridges 52, 53 and the first and second cap bead/ridges 60, 62 will also have the added purpose of reducing or eliminating the gap between the muffler shell body 12 and the muffler end caps 22, 26. Gaps between the muffler shell body 12 and the muffler end caps 22, 26 can cause major issues with various welding process, including induction brazing, laser brazing, GMAW and GTAW (Gas Tungsten Arc Welding).

In addition, the muffler joints 11 defined by the first and second shell bead/ridges 52, 53 and the first and second cap bead/ridges 60, 62 also ideally lends itself to laser brazing in that it provides added surface for the capillary action of a braze welding process. Further, by employing a muffler shell body 12 with the bead/ridge described above, it helps to make the end of the muffler shell body 12 more ridged and therefore more repeatable in both form (shape) and size/dimension over the top of the bead/ridge. A better fitting muffler end cap to muffler shell body joint allows for a better fit of cap/shell joint for the downstream welding processes during the muffler manufacturing process.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A muffler, comprising:

an elongated muffler shell body including a first end with a first opening, a second end with a second opening, an exterior surface forming an exposed surface of the muffler, and an interior surface forming an internal surface of the muffler;

a first muffler end cap mounted on the first end of the muffler shell body in a manner defining a first muffler joint coupling the first muffler end cap to the first end of the muffler shell body, the first muffler end cap includes a circumferential edge with a body of the first muffler end cap extending within a space defined by the circumferential edge of the first muffler end cap;

a second muffler end cap mounted on the second end of the muffler shell body in a manner defining a second muffler joint coupling the second muffle end cap to the second end of the muffler shell body, the second muffler end cap includes a circumferential edge with a body of the second muffler end cap extending within a space defined by the circumferential edge of the second muffler end cap;

a louver and baffle assembly within an interior of the muffler shell body;

the first end of the muffler shell body includes a first shell bead/ridge and the second end of the muffler shell body includes a second shell bead/ridge, and the circumferential edge of the first muffler end cap includes a first cap bead/ridge shaped and dimensioned for engagement with the first shell bead/ridge to define the first muffler joint and the circumferential edge of the second muffler end cap includes a second cap bead/ridge shaped and dimensioned for engagement with the second shell bead/ridge to define the second muffler joint, wherein each of the first cap bead/ridge and the second cap bead/ridge includes a first cap bead/ridge segment and a second cap bead/ridge segment connected by an cap connecting segment to define a recess shaped and dimensioned for respectively receiving the first and second shell bead/ridge and the second shell bead/ridge in a manner defining a radial ball joint providing a controlled area/joint for filler metal to form into and thus maximize the contact area.

2. The muffler according to claim 1, wherein each of the first shell bead/ridge and the second shell bead/ridge extends about an entire circumference of the muffler shell body.

3. The muffler according to claim 2, wherein the first shell bead/ridge and the second shell bead/ridge are mirror images of the each other.

4. The muffler according to claim 1, wherein the muffler shell body has a single wall construction composed of a metal sheet, and the flat sheet includes a first edge and a second edge with first and second lateral edges extending between the first edge and the second edge.

5. The muffler according to claim 4, wherein each of the first shell bead/ridge and the second shell bead/ridge includes a first shell bead/ridge segment and a second shell bead/ridge segment connected by an arcuate curved shell connecting segment.

6. The muffler according to claim 5, wherein the first shell bead/ridge segment and the second shell bead/ridge segment extend in a direction perpendicular to a longitudinal axis of muffler shell body.

7. The muffler according to claim 1, wherein the second cap bead/ridge segment is shorter than the first cap bead/ridge segment.

8. The muffler according to claim 1, wherein each of the first shell bead/ridge and the second shell bead/ridge includes a first shell bead/ridge segment and a second shell bead/ridge segment connected by an arcuate curved shell connecting segment.

9. The muffler according to claim 8, wherein the first shell bead/ridge segment and the second shell bead/ridge segment extend in a direction perpendicular to a longitudinal axis of muffler shell body.

10. The muffler according to claim 1, wherein each of the first cap bead/ridge and the second cap bead/ridge consists essentially of the first cap bead/ridge segment and the second cap bead/ridge segment connected by the cap connecting segment.

11. The muffler according to claim 1, wherein the first shell bead/ridge segment and the second shell bead/ridge segment extend in a direction perpendicular to a longitudinal axis of muffler shell body.

12. The muffler according to claim 11, wherein the second cap bead/ridge segment is shorter than the first cap bead/ridge segment.

13. The muffler according to claim 1, wherein the first cap bead/ridge segment and the second cap bead/ridge segment extend in a direction parallel to a longitudinal axis of the muffler shell body and perpendicular to a plane in which the muffler end cap lies.

14. The muffler according to claim 1, wherein the first muffler end cap covers the first end of the muffler shell body and the second muffler end cap covers the second end of the muffler shell body.

15. The muffler according to claim 14, wherein the first muffler end cap includes an aperture and the second muffler end cap includes an aperture.

16. The muffler according to claim 1, wherein the muffler is composed of stainless steel.

* * * * *